US010473023B2

(12) United States Patent
Gonze et al.

(10) Patent No.: US 10,473,023 B2
(45) Date of Patent: Nov. 12, 2019

(54) THERMAL MANAGEMENT SYSTEM AND METHOD FOR A VEHICLE

(71) Applicant: GM GLOBAL TECHNOLOGY OPERATIONS LLC, Detroit, MI (US)

(72) Inventors: Eugene V. Gonze, Pinckney, MI (US); Daniel J. Shepard, Ann Arbor, MI (US); Michael J. Paratore, Jr., Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/883,257

(22) Filed: Jan. 30, 2018

(65) Prior Publication Data

US 2019/0234292 A1 Aug. 1, 2019

(51) Int. Cl.

| | |
|---|---|
| ***F01P 7/14*** | (2006.01) |
| ***F01P 7/16*** | (2006.01) |
| ***F01N 3/04*** | (2006.01) |
| ***F01P 5/10*** | (2006.01) |
| *F01P 3/18* | (2006.01) |

(52) U.S. Cl.

CPC ..... *F01P 7/165* (2013.01); *F01N 3/046* (2013.01); *F01P 5/10* (2013.01); *F01P 7/161* (2013.01); *F01P 2003/182* (2013.01); *F01P 2007/146* (2013.01); *F01P 2025/30* (2013.01); *F01P 2025/32* (2013.01); *F01P 2025/40* (2013.01)

(58) Field of Classification Search

CPC ..... F01P 2007/146; F01P 7/16; F01P 7/164; B60H 1/00885; B60H 1/00735

USPC ..... 123/41.09, 41.05, 41.08, 41.1, 41.44, 123/41.72, 41.74

See application file for complete search history.

(56) References Cited

U.S. PATENT DOCUMENTS

| | | | | |
|---|---|---|---|---|
| 4,369,738 | A * | 1/1983 | Hirayama | F01P 7/165 123/41.1 |
| 8,997,483 | B2 | 4/2015 | Zahdeh et al. | |
| 9,567,892 | B2 | 2/2017 | Bilancia | |
| 9,611,781 | B2 * | 4/2017 | Moscherosch | F01P 7/162 |
| 9,732,662 | B2 | 8/2017 | Bockenstette et al. | |
| 2004/0206337 | A1 * | 10/2004 | Tokuyasu | F02D 41/064 123/497 |
| 2006/0213460 | A1 * | 9/2006 | Aoki | B60H 1/00885 123/41.05 |
| 2008/0221778 | A1 * | 9/2008 | Kakuho | F02D 19/12 701/103 |

(Continued)

*Primary Examiner* — Long T Tran
*Assistant Examiner* — James J Kim

(57) ABSTRACT

A vehicle thermal management system includes an engine, a coolant pump, a first heat exchanger, a first valve in communication with the first heat exchanger, a second valve having a plurality of outlets, a second heat exchanger in communication with a first of the plurality of outlets, a third heat exchanger in communication with a second of the plurality of outlets, a bypass fluid conduit in communication with a third of the plurality of outlets, and a controller that determines a first potential benefit based upon a loss function of the second heat exchanger, determines a second potential benefit based upon a loss function of the third heat exchanger, compares the first potential to the second potential, and proportionally distributes flow between the first heat exchanger, the second heat exchanger, the third heat exchanger, and the bypass fluid conduit based upon the comparison.

16 Claims, 3 Drawing Sheets

(56) References Cited

U.S. PATENT DOCUMENTS

| | | | | |
|---|---|---|---|---|
| 2014/0196674 | A1* | 7/2014 | Quix | F01P 7/14<br>123/41.09 |
| 2017/0122182 | A1 | 5/2017 | Gonze et al. | |

* cited by examiner

THERMAL MANAGEMENT SYSTEM AND METHOD FOR A VEHICLE

FIELD

The present disclosure relates to a thermal management system and method for a vehicle.

INTRODUCTION

This introduction generally presents the context of the disclosure. Work of the presently named inventors, to the extent it is described in this introduction, as well as aspects of the description that may not otherwise qualify as prior art at the time of filing, are neither expressly nor impliedly admitted as prior art against this disclosure.

Current production motor vehicles, such as the modern-day automobile, are originally equipped with a powertrain that operates to propel the vehicle and power the onboard vehicle electronics. In automotive applications, for example, the propulsion system may be generally typified by a prime mover that delivers driving power through a transmission to a final drive system (e.g., rear differential, axles, and road wheels). Automobiles have traditionally been powered by a reciprocating-piston type internal combustion engine assembly because of its ready availability and relatively inexpensive cost, light weight, and overall efficiency. Such engines may include, for example, compression-ignited (CI) diesel engines, spark-ignited (SI) gasoline engines, flex-fuel models, two, four and six-stroke architectures, and rotary engines, as some non-limiting examples. Hybrid and full-electric vehicles, on the other hand, may utilize alternative power sources, such as fuel-cell or battery powered electric motor-generators, to propel the vehicle and minimize/eliminate reliance on a combustion engine for power.

During normal operation, internal combustion engine (ICE) assemblies and large traction motors (i.e., for hybrid and full-electric powertrains) may generate a significant amount of heat. To prolong the operational life of the prime mover(s) and the various components packaged within the engine compartment, vehicles may be equipped with passive and active features for managing heat in the engine bay. Passive measures for alleviating excessive heating within the engine compartment may include, for example, thermal wrapping the exhaust runners, thermal coating of the headers and manifolds, and integrating thermally insulating packaging for heat sensitive electronics. Active means for cooling the engine compartment include radiators, coolant pumps, and fans. As another option, some vehicle may include vents that expel hot air and amplify convective cooling within the engine bay.

Active thermal management systems for vehicles may employ an onboard vehicle controller or electronic control module to regulate operation of a cooling circuit that distributes liquid coolant, generally of oil, water, and/or anti-freeze, throughout the components of the vehicle. A coolant pump may propel cooling fluid through coolant passages in the engine block, the transmission case and sump, and to a radiator or other heat exchanger. A radiator may transfer heat from the vehicle to ambient air. Some thermal management systems may use a split cooling system layout that features separate circuits and water jackets for the cylinder head and engine block such that the head can be cooled independently from the block. The cylinder head, which has a lower mass than the engine block and is exposed to very high temperatures, heats up much faster than the engine block and, thus, generally needs to be cooled first. Advantageously, during warm up, a split layout allows the system to first cool the cylinder head and, after a given time interval, then cool the engine block.

SUMMARY

In an exemplary aspect, a thermal management system for a vehicle includes an engine producing heat energy and having a coolant inlet and a coolant outlet, a coolant pump having an outlet in communication with the engine coolant inlet, a first heat exchanger having a coolant inlet in communication with the engine coolant outlet and a coolant outlet in communication with an inlet of the coolant pump, a first valve in fluid communication with the first heat exchanger and operable to control a flow of coolant through the first heat exchanger, a second valve having a coolant inlet in communication with the engine coolant outlet and a plurality of coolant outlets, a second heat exchanger having a coolant inlet in communication with a first of the plurality of valve coolant outlets and a coolant outlet in communication with the pump coolant inlet, a third heat exchanger having a coolant inlet in communication with a second of the plurality of valve coolant outlets and a coolant outlet in communication with the pump coolant inlet, a bypass fluid conduit having a coolant inlet in communication with a third of the plurality of valve coolant outlets and a coolant outlet in communication with the pump coolant inlet, and a controller in communication with the first valve and the second valve for selectively operating the first and second valves. The controller is programmed to determine a first potential benefit based upon a loss function of the second heat exchanger, determine a second potential benefit based upon a loss function of the third heat exchanger, compare the first potential to the second potential, and operate at least one of the first valve and the second valve to proportionally distribute coolant flow between the first heat exchanger, the second heat exchanger, the third heat exchanger, and the bypass fluid conduit based upon a result of the comparison.

In another exemplary aspect, the system further includes an engine coolant outlet temperature sensor that provides an engine coolant outlet temperature signal to the controller.

In another exemplary aspect, the system further includes a transmission fluid temperature sensor that provides a transmission fluid temperature signal to the controller and the controller determines the first potential further based upon the engine coolant outlet temperature signal and the transmission fluid temperature signal.

In another exemplary aspect, the system further includes an engine coolant inlet temperature sensor that outputs an engine coolant inlet temperature to the controller.

In another exemplary aspect, the system further includes an engine oil temperature sensor that provides an engine oil temperature signal to the controller and one of the second heat exchanger and the third heat exchanger is an engine oil heat exchanger adapted to exchange heat between a coolant flowing through the engine oil heat exchanger and engine oil in the engine, and the controller determines the second potential further based upon the engine coolant inlet temperature signal and the engine oil temperature signal.

In another exemplary aspect, the system further includes an engine coolant inlet temperature sensor that outputs an engine coolant inlet temperature signal to the controller, and an engine coolant outlet temperature sensor that outputs an engine coolant outlet temperature signal to the controller, one of the second heat exchanger and the third heat exchanger is an transmission fluid heat exchanger adapted to exchange heat between a coolant flowing through the transmission fluid heat exchanger and transmission fluid in a transmission, and the controller further proportionally distributes coolant flow based upon the engine coolant inlet temperature signal and the engine coolant outlet temperature signal.

In another exemplary aspect, the coolant pump is an electronically controlled variable flow coolant pump.

In another exemplary aspect, the controller is further programmed to control the flow of coolant through the electronically variable coolant pump based upon a result of the comparison.

In another exemplary aspect, the system further includes a heater core having an inlet in communication with a third of the plurality of valve coolant outlets and a coolant outlet in communication with the pump coolant inlet.

In this manner, an exemplary embodiment of the thermal management system for a vehicle in accordance with the present disclosure is capable of arbitrating the distribution of heat energy throughout a vehicle with much greater flexibility than has conventionally possible based upon a comparison of potential benefits of distributing that heat energy between a plurality of vehicle components. This greatly improves the ability to maximize CO2 benefits, fuel economy, emissions, performance and the like without limitation. Additionally, the thermal management system for a vehicle in accordance with the present disclosure further enables the use of common parts across multiple vehicle applications which may greatly reduce vehicle design costs and component costs.

Further areas of applicability of the present disclosure will become apparent from the detailed description provided below. It should be understood that the detailed description and specific examples are intended for purposes of illustration only and are not intended to limit the scope of the disclosure.

The above features and advantages, and other features and advantages, of the present invention are readily apparent from the detailed description, including the claims, and exemplary embodiments when taken in connection with the accompanying drawings.

BRIEF DESCRIPTION OF THE DRAWINGS

The present disclosure will become more fully understood from the detailed description and the accompanying drawings, wherein.

DETAILED DESCRIPTION

Figure 1:
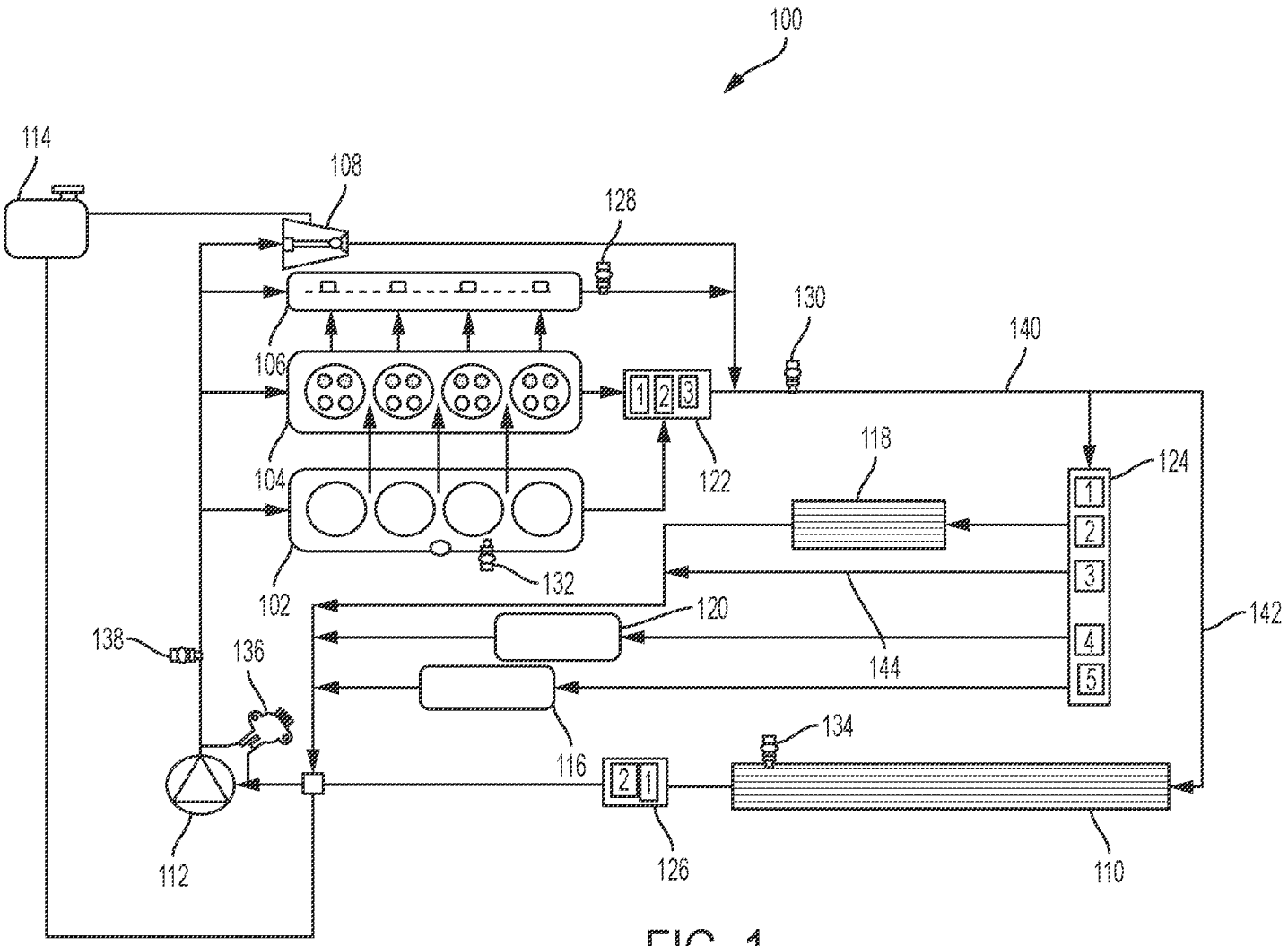
FIG. 1 is a schematic illustration of an exemplary thermal management system for a vehicle in accordance with the present disclosure.

The inventors of the present disclosure understood that the efficiency and performance of many vehicle components, including those of the vehicle propulsion system may be sensitive to temperature. For example, the operating efficiency of a transmission may be particularly sensitive to temperature and with conventional thermal management systems the ability to maintain an optimum temperature has been challenging. Existing thermal management systems tend to be quite limited in their ability to optimally distribute heat between components in the vehicle. The present disclosure, as will be explained in detail below, provides a thermal management system and method which is highly flexible in its ability to distribute heat. In this manner, not only may the components of the vehicle be operated at desired temperatures, but the flexibility further enables decisions to be made by the control system and method to prioritize the distribution of heat. Decisions regarding optimum fuel economy, performance, emissions and the like without limitation and the system may then distribute the heat throughout the vehicle in accordance with those decisions. This has not previously been possible with conventional vehicle thermal management systems.

Co-pending, co-assigned, U.S. patent application Ser. No. 15/633,314, the disclosure of which is incorporated by reference herein in its entirety, discloses a two-valve, split-layout thermal management system for a vehicle which provides the same thermal management capabilities of three and four-valve systems. While that disclosure illustrates a system architecture which may also enable decisions which provide flexible distribution of heat throughout components in a vehicle, that disclosure does not describe how those decisions may be made. The present disclosure describes not only a closely related architecture providing similar flexibility in heat distribution, but also provides exemplary methods and systems for deciding where and how to distribute heat between components in a vehicle.

Another significant advantage provided by the present disclosure is the flexibility that the architecture and control methods and systems provide with respect to the ability to easily use common components between varying vehicle applications. Previously, the limitations of conventional thermal management systems have required a complete re-design of the hardware for the thermal management system for each different type of vehicle. In other words, the hardware in these conventional systems were specific to each vehicle application and it has not often been possible to use common system components for different vehicle applications. With the thermal management systems and methods of the present disclosure, commonality of components in the thermal management system across multiple vehicle platforms and applications may be dramatically increased. Rather than having to completely re-design system components for each vehicle application, the present disclosure enables the use of the same and/or very similar components across multiple different platforms merely by adjusting the coefficients in the control system. The present disclosure greatly reduces the complexity of vehicle design and component cost.

FIG. 1 illustrates an exemplary active thermal management system 100 for various components in a vehicle. The thermal management system includes an engine block 102, a cylinder head 104, and an exhaust manifold 106. The exhaust manifold may be an integrated exhaust manifold in which the exhaust manifold is integrated into the cylinder heading, a separate (non-integrated) exhaust manifold and/or the like without limitation which has a cooling jacket through which coolant flows. The thermal management system 100 further includes a forced-induction component 108, such as, for example a turbocharger. In other exemplary embodiments in accordance with the present application, the forced-induction component 108 may be a supercharger, a twincharger, a variable geometry turbine (VGT) with a VGT actuator arranged to move the vanes to alter the flow of exhaust gases through the turbine, and/or the like without limitation. Alternatively, the thermal management system might not include a forced-induction component and be naturally aspirated. The invention of the present disclosure is applicable in either configuration.

The thermal management system 100 further includes a heat exchanger (or radiator) 110, for exchanging heat between an internally flowing liquid coolant and an external fluid medium (ambient air) and/or an internal fluid medium (refrigerant). A coolant pump 112, which may be of the fixed, positive or variable displacement type, is operable for circulating liquid coolant cooled by the radiator 110 throughout the system 100. In a preferred embodiment, the pump 112 may be an electric pump which provides increased control over the volume of flow in comparison to a mechanical pump which only vary the volume of flow based upon the operated speed of the engine. In this manner, a pump having a controllable volume of flow enables significantly improved control over the amount of heat which may be transferred to, distributed between, and/or rejected from components within a vehicle. A surge tank 240 may provide a temporary storage container for retaining coolant overflow due to expansion of the coolant as it heats up, and returning coolant when cooled.

Thermal management system 100 is a split cooling system layout for independently managing heat-extracting coolant flow through the block 102, head 104, exhaust manifold 106, and turbocharger 108—and a transmission heat exchanger 116. The illustrated thermal management system 100 also independently manages coolant flow to the radiator 110, a cabin heater core 118, engine oil heat exchanger 120, and the transmission heat exchanger 116. With this configuration, the thermal management system 100 is capable of deciding which part or parts of the engine to cool at a given time, and to which component or components of the vehicle propulsion system or passenger cabin energy will be delivered in the form of heated coolant. Coolant circulation may be governed by a controller (not shown) through controlled operation of at least the pump 112, an engine rotary valve 122, a main rotary valve 124, and radiator valve 126. The controller may control operation of the pump 112, and valves 122, 124, and 126, in response to signals received from sensors, such as, for example, manifold outlet temperature sensor 128, engine outlet temperature sensor 130, block temperature sensor 132, radiator coolant temperature sensor 134, pump pressure sensor 136, engine inlet temperature sensor 138 and/or the like without limitation. The controller may be incorporated into, be distinct from yet collaborative with, or be fabricated as a wholly independent from other controllers in the vehicle and/or vehicle propulsion system.

The thermal management system 100 employs several branches of conduits for fluidly connecting the illustrated components and splitting the coolant flow among the several loops of the system. The thermal management system 100 may include an engine outlet conduit 140 which receives all coolant flowing through the block 102, the head 104, the manifold 106, and the turbocharger 108, the proportions through each of those components being determined by the engine rotary valve 122. The thermal management system 100 may also include a radiator conduit 142 having an inlet in communication with the engine outlet conduit 140 and an outlet in communication with an inlet to the pump 112. The flow of coolant through the radiator conduit 142 is determined by the radiator valve 126. An independently controlled radiator conduit which places the radiator on its own completely separate and independent flow path feature is quite unique and not present in convention vehicle thermal management systems. This obviates the necessity of providing a radiator bypass flow path which is directly tied to the flow through the radiator, as may be found in many conventional thermal management systems. In contrast, the exemplary thermal management system architecture enables complete control over the amount of energy rejected from the system overall, via the radiator, and enables independent and complete control over the distribution of heat to vehicle components which may consume (distribute heat to vehicle components other than those directly related to the engine) and/or maintain heat within the system via the use of a bypass conduit 144 which then returns the heat energy back to the engine components. In this manner, control over the heat energy present within the entire thermal management system may be directly and independently controlled. Thereby further enabling distribution of heat between components that may benefit from additional heat rather than rejecting and/or wasting that heat energy by rejecting it to the ambient environment as has been done by conventional vehicle thermal management systems.

Co-pending, co-assigned U.S. patent application Ser. No. 15/145,417, the disclosure of which is hereby incorporated herein in its entirety, discloses an inventive thermal management system having a radiator conduit which is separate from and independently controlled from other flow paths. As described above, this enables consideration of overall system heat when deciding whether and when to reject heat from the overall system. However, in contrast to the present disclosure, that disclosure describes a system and method which determines the flow through the radiator based upon the cooling requirements of the engine only, and does not consider the thermal considerations of other components within the vehicle.

The main rotary valve 124 also has an inlet in communication with the engine outlet conduit 140 and determines the proportion of flow through that valve 124 and into one or more heat exchangers, such as, for example, the cabin heater core 118, the engine oil heater 120, and transmission heat exchanger 116, and/or through a bypass conduit 144. In this manner, through control over the main rotary valve 124, the radiator valve 126 and the pump 112, unprecedented flexibility is achieved in how much heat may be independently transferred between components in the vehicle, rejected to the ambient environment (via the radiator 110), and/or maintained within the system (via the bypass conduit 144). In other words, the inventive thermal management system of the present application may be broadly characterized by a plurality of operating modes: 1) a bypass mode, 2) a heat rejection mode; 3) a heat transfer mode; and 4) any combination of these modes.

It is further envisioned that the number, arrangement, and individual characteristics of the fluid ports in any given valve may be varied from that which are shown in the drawings and remain within the scope of the present disclosure.

The inventors of the present disclosure realized that the optimum distribution of heat with a vehicle thermal management system may be determined based upon various loss functions for each component within the vehicle thermal management system. In an exemplary embodiment of the system and method of the present disclosure, the total heat energy within the vehicle thermal management system may be evaluated, the distribution of that heat between components of the system may be prioritized based upon a comparison of loss functions of those components, the capacity of each component to generate and/or receive that heat, and any amount of excess heat may then be independently and separately rejected to the ambient environment using a controllable flow through the radiator flow path. In other words, in contrast to conventional vehicle thermal management systems, the present disclosure has the ability to precisely control the distribution of heat within the vehicle thermal management systems to where it may do the most good, given current operating conditions.

In another exemplary embodiment, in addition to prioritizing the distribution of heat within the system and/or rejection of heat out of the system based upon a comparison of loss functions of each component, the ability to opt-out of that loss function prioritization may be provided based upon other factors such as, for example, a heater core request based upon a passenger request for cabin heat, and/or protective conditions in which predetermined threshold temperatures may indicate a strong prioritization to prevent damage to components of the vehicle. In contrast to conventional vehicle thermal management systems, which may have been limited to sending all heat to a heater core when heat is demanded by the heater core and rejecting any and all excess heat from the system via the radiator, in an exemplary embodiment of the present invention, knowledge of the amount of overall heat energy in the system and the capacity of the heater core and/or demand from the heater core to receive that energy enables the distribution of any excess heat to other vehicle components that may benefit from that heat. For example, in an instance where the engine may be producing five kilowatts of heat energy and the heater core only has a capacity to receive three kilowatts, an exemplary embodiment of the present disclosure recognizes that situation and decides where to send the remaining two kilowatts of heat energy within the vehicle thermal management system based upon a comparison of the loss functions of each component.

Further, the improved flexibility of the present disclosure, enables precise control over the ratio of heat flow between multiple components which has previously not been possible in convention vehicle thermal management systems. For example, in some conditions, it may be desirable to send heat to the engine oil heat exchanger 120 and to the transmission heat exchanger 116 simultaneously and to control not only the rate of heat provided to each of these components independently, but to also determine the flow of heat to or from each individual component completely independently of other components within the vehicle thermal management system. Conventional vehicle thermal management systems have been limited in that the flow of heat to the engine oil heat exchanger has been tied to the flow of coolant to the transmission heat exchanger. Thus, in those systems, even when additional benefits might be available to further heat the engine oil, when the transmission reaches a predetermined maximum temperature, the flow to both of these exchangers is cut off. The present disclosure completely obviates this problem.

In an exemplary embodiment of the present disclosure a loss function may be considered analogous to an opportunity cost. The costs and benefits of heat exchange with any given vehicle component may be modeled using a loss function and the present disclosure uses the loss function for each component to prioritize the distribution of heat in the vehicle thermal management system. For example, the loss function of a transmission may indicate that a certain amount of fuel savings may be achieved by sending a certain amount of heat at a given time to the transmission and the loss function of the engine may indicate that a performance and/or efficiency improvement which correlates to another amount of fuel savings if the engine receives that amount of heat. A comparison of those benefits may then enable a prioritization of the heat distribution between the transmission and the engine in accordance with the present disclosure. If the loss function of the transmission indicates that a greater benefit may be achieved in comparison with the loss function of the engine, then an exemplary embodiment of the present disclosure may prioritize directing heat to the transmission over sending heat to the engine.

In an exemplary embodiment, the present disclosure may integrate these loss functions over time in order to compensate for the conditions and phases of operation of the vehicle. For example, conditions of the vehicle and the history of these conditions may further indicate an adjustment of the priorization based upon whether the vehicle has just started, is in the middle of a trip, and/or is about to shut down.

Further, in addition to a comparison of loss functions between vehicle components, an exemplary embodiment of the present disclosure may further evaluate the capacity of each vehicle component to receive heat. For example, the amount of heat that may be available may exceed the capacity of a vehicle component to receive that heat even though heat may be beneficially received by that component. In such an instance, an exemplary embodiment of the present disclosure may proportionally distribute the excess heat to other vehicle components and/or to the radiator to remove the heat from the system when that heat capacity may be exceeded.

Figure 2:
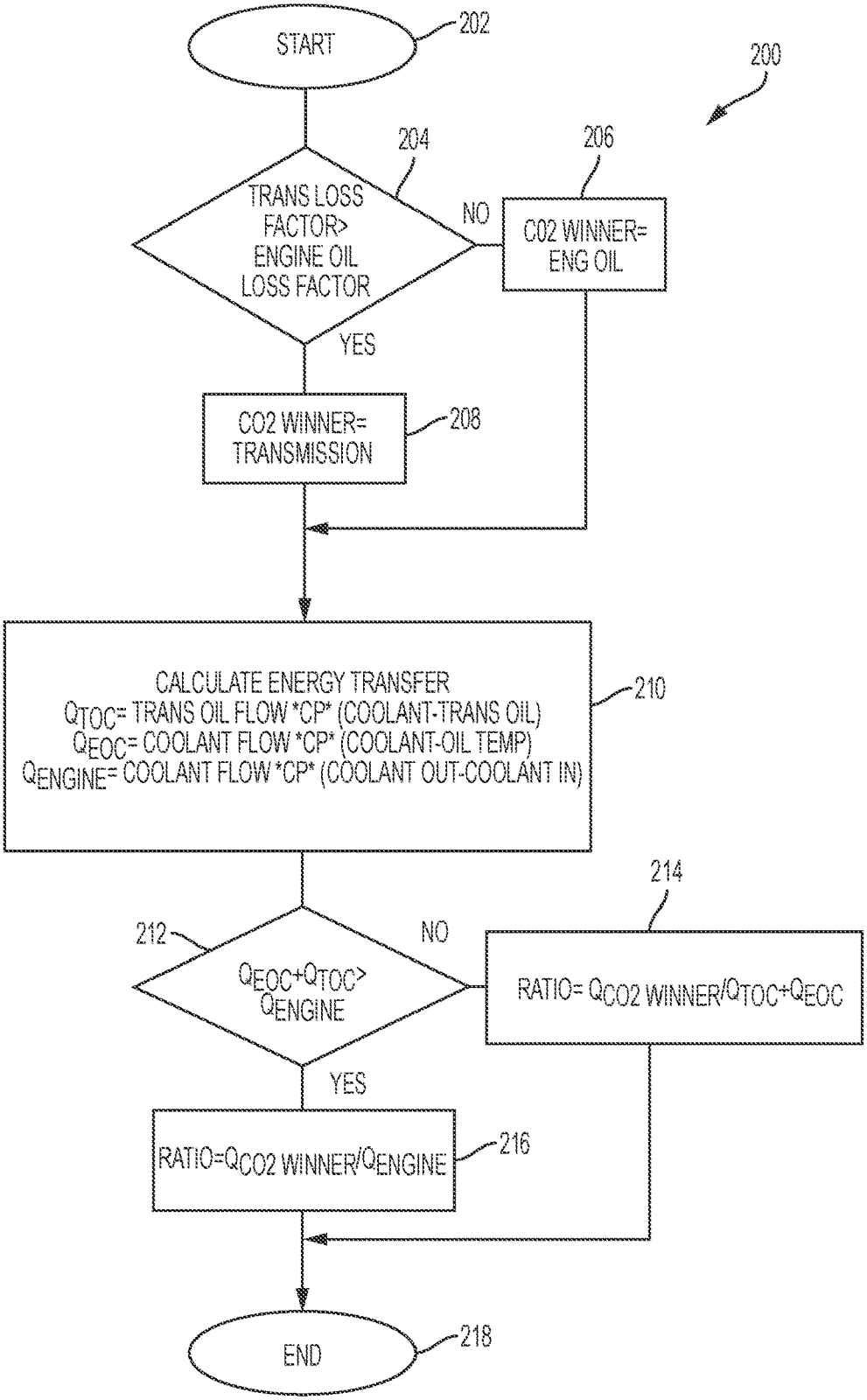
FIG. 2 is a flowchart of an exemplary method for operating a thermal management system for a vehicle in accordance with the present disclosure.

FIG. 2 is a flowchart 200 of an exemplary method for prioritizing and distributing heat in a vehicle thermal management system. The method starts at step 202 and continues to step 204. In step 204, the method determines whether conditions in the vehicle thermal management system indicate that the loss function of the transmission has a larger value than that of the loss function for the engine. In the exemplary embodiment of FIG. 2, the method compares the benefit/loss for each of the transmission and the engine in terms of Carbon Dioxide (CO2) benefits. If, in step 204, the method determines that the CO2 benefit that may be achieved by the transmission is greater than that of the engine, then the method continues to step 208 and sets a "CO2 winner" to be the transmission. In contrast, if in step 204, the method determines that the CO2 benefit that may be achieved by the transmission is not greater than that of the engine, then the method continues to step 206. In step 206, the method sets a "CO2 winner" to be the engine. The method then continues to step 210.

In step 210, the method calculates the energy transfer for each of the transmission, the engine oil, and the amount of heat energy being produced by the engine. The amount of energy transfer for the transmission being determined based upon the volume of flow through the transmission heat exchanger, the specific heat of the coolant and the difference in temperatures between the coolant entering the transmission heat exchanger and the temperature of the transmission fluid. The amount of energy transfer for the engine oil being determined based upon the volume of flow through the engine oil heat exchanger, the specific heat of the coolant and the difference in temperatures between the coolant entering the engine oil heat exchanger and the temperature of the engine oil. The amount of heat energy generated by the engine being determined based upon the volume of coolant flowing through the engine, the specific heat of the coolant, and the difference between the temperature of the coolant entering the engine and the temperature of the coolant exiting the engine. The method then continues to step 212.

In step 212, the method determines whether the sum of the energy transfer to the transmission and the engine oil is greater than the heat energy being generated by the engine. If, in step 212, the method determines that the sum of the energy transfer to the transmission and the engine oil is greater than the heat energy being generated by the engine then the method continues to step 216. In step 216, the method controls the valving in the vehicle thermal management system such that the ratio of flow between the engine oil heat exchanger and the transmission heat exchanger is set to equal the ratio of the heat transfer of the CO2 winner over the heat generated by the engine. If, however, in step 212 the method determines that the sum of the energy transfer to the transmission and the engine oil is not greater than the heat energy being generated by the engine then the method continues to step 214. In step 214, the method controls the valving in the vehicle thermal management system such that the ratio of flow between the engine oil heat exchanger and the transmission heat exchanger is set to equal the ratio of the heat transfer of the CO2 winner over the heat generated by the sum of heat transfer to the transmission heat exchanger and the heat transfer to the engine oil heat exchanger. The method then continues to step 218 where the method ends.

Figure 3:
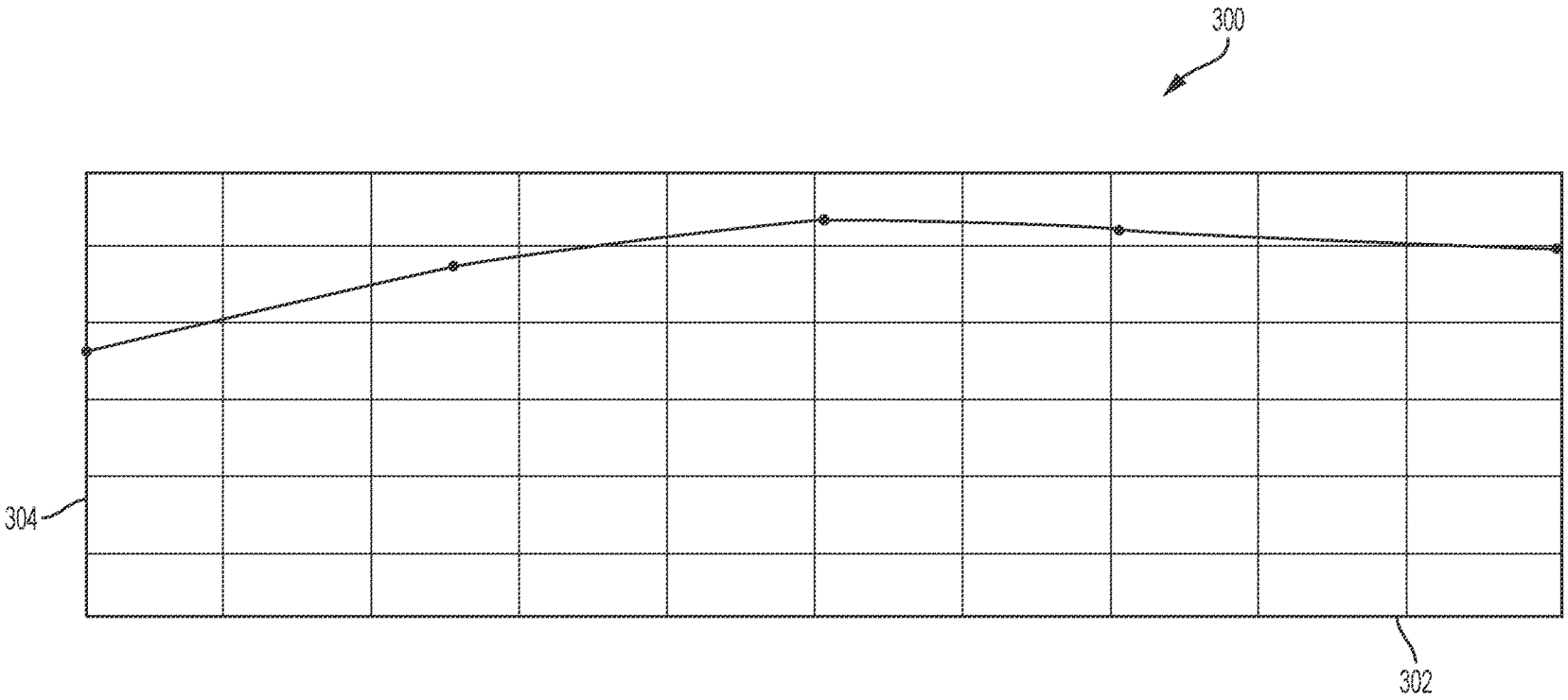
FIG. 3 is a graph that illustrates potential benefits that are obtainable with an exemplary embodiment of the present disclosure.

FIG. 3 is a graph 300 illustrating the CO2 benefits that are obtainable with an exemplary embodiment of the present disclosure in comparison to a conventional vehicle thermal management system. The horizontal axis 302 represents the transmission to engine oil energy ratio as may have been determined as described above with reference to the flowchart of FIG. 2. The vertical axis 304 represents the fuel efficiency gain on a percentage basis. A plot of the fuel efficiency percentage gain on the graph based upon the ratio illustrates that an increase in fuel efficiency overall may be gained by proportionally dividing the flow (i.e. setting the ratio of flow) between the transmission heat exchanger and the engine oil heat exchanger. For example, a reduction of the ratio from sending 100% of the flow to the transmission heat exchanger (i.e. the extreme far right side of the graph) to a roughly 50/50 split provides an overall improvement in overall fuel efficiency.

This description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A thermal management system for a vehicle, the system comprising:

an engine producing heat energy and having a coolant inlet and a plurality of coolant outlets;

a coolant pump having an outlet in communication with the engine coolant inlet;

a radiator having a coolant inlet and a coolant outlet, wherein the radiator exchanges heat between the coolant and an atmosphere surrounding the radiator;

a first valve having a coolant inlet in communication with the coolant outlet of the radiator and having a coolant outlet in fluid communication with the coolant pump and operable to control a flow of coolant through the radiator;

a second valve having a plurality of coolant inlets each in communication with one of the plurality of engine coolant outlets and having a coolant outlet;

a third valve having a coolant inlet in communication with the coolant outlet of the second valve and having a plurality of valve coolant outlets;

a cabin heater core having a coolant inlet in communication with a first of the plurality of valve coolant outlets of the third valve and a coolant outlet in communication with the pump coolant inlet;

one of an engine oil heat exchanger and a transmission fluid heat exchanger having a coolant inlet in communication with a second of the plurality of valve coolant outlets of the third valve and a coolant outlet in communication with the pump coolant inlet;

a bypass fluid conduit having a coolant inlet in communication with a third of the plurality of valve coolant outlets of the third valve and a coolant outlet in communication with the pump coolant inlet; and a controller in communication with the first valve, the second valve, and the third valve for selectively operating the first, second, and third valves, wherein the controller is programmed to:

determine a first potential benefit based upon a loss function of one of the radiator, the cabin heater core, the engine oil heat exchanger, and the transmission fluid heat exchanger;

determine a second potential benefit based upon a loss function of another one of the radiator, the cabin heater core, the engine oil heat exchanger, and the transmission fluid heat exchanger;

compare the first potential benefit to the second potential benefit; and operate at least one of the first valve, the second valve, and the third valve to proportionally distribute coolant flow between the radiator, the cabin heater core, the engine oil heat exchanger, the transmission fluid heat exchanger, and the bypass fluid conduit based upon a result of the comparison.

2. The system of claim 1, further comprising an engine coolant outlet temperature sensor that provides an engine coolant outlet temperature signal to the controller.

3. The system of claim 2, further comprising a transmission fluid temperature sensor that provides a transmission fluid temperature signal to the controller, wherein the controller determines the first potential further based upon the engine coolant outlet temperature signal and the transmission fluid temperature signal.

4. The system of claim 1, further comprising an engine coolant inlet temperature sensor that outputs an engine coolant inlet temperature to the controller.

5. The system of claim 4, further comprising an engine oil temperature sensor that provides an engine oil temperature signal to the controller, wherein the engine oil heat exchanger is adapted to exchange heat between a coolant flowing through the engine oil heat exchanger and engine oil in the engine and wherein the controller determines the second potential further based upon the engine coolant inlet temperature signal and the engine oil temperature signal.

6. The system of claim 1, further comprising:

an engine coolant inlet temperature sensor that outputs an engine coolant inlet temperature signal to the controller; and an engine coolant outlet temperature sensor that outputs an engine coolant outlet temperature signal to the controller, wherein the transmission fluid heat exchanger is adapted to exchange heat between a coolant flowing through the transmission fluid heat exchanger and transmission fluid in a transmission and wherein the controller further proportionally distributes coolant flow based upon the engine coolant inlet temperature signal and the engine coolant outlet temperature signal.

7. The system of claim 1, wherein the coolant pump comprises an electronically controlled variable flow coolant pump.

8. The system of claim 7, wherein the controller is further programmed to control the flow of coolant through the electronically variable coolant pump based upon a result of the comparison.

9. A method for controlling a thermal management system in a vehicle that includes an engine producing heat energy and having a coolant inlet and a plurality of coolant outlets, a coolant pump having an outlet in communication with the engine coolant inlet, a radiator having a coolant inlet and a coolant outlet, wherein the radiator exchanges heat between the coolant and an atmosphere surrounding the radiator, a first valve having a coolant inlet in communication with the coolant outlet of the radiator and having a coolant outlet in fluid communication with the coolant pump and operable to control a flow of coolant through the radiator, a second valve having a plurality of coolant inlets each in communication with one of the plurality of engine coolant outlets and having a coolant outlet, a third valve having a coolant inlet in communication with the coolant outlet of the second valve and having a plurality of valve coolant outlets, a cabin heater core having a coolant inlet in communication with a first of the plurality of valve coolant outlets of the third valve and a coolant outlet in communication with the pump coolant inlet, one of an engine oil heat exchanger and a transmission fluid heat exchanger having a coolant inlet in communication with a second of the plurality of valve coolant outlets of the third valve and a coolant outlet in communication with the pump coolant inlet, and a bypass fluid conduit having a coolant inlet in communication with a third of the plurality of valve coolant outlets of the third valve and a coolant outlet in communication with the pump coolant inlet, the method comprising:

determining a first potential benefit based upon a loss function of one of the radiator, the cabin heater core, the engine oil heat exchanger, and the transmission fluid heat exchanger;

determining a second potential benefit based upon a loss function of another one of the radiator, the cabin heater core, the engine oil heat exchanger, and the transmission fluid heat exchanger;

comparing the first potential benefit to the second potential benefit; and operating at least one of the first valve, the second valve, and the third valve to proportionally distribute coolant flow between the radiator, the cabin heater core, the engine oil heat exchanger, the transmission fluid heat exchanger, and the bypass fluid conduit based upon a result of the comparison.

10. The method of claim 9, wherein the vehicle further includes an engine coolant outlet temperature sensor that generates an engine coolant outlet temperature signal.

11. The method of claim 10, wherein the vehicle further includes a transmission fluid temperature sensor that generates a transmission fluid temperature signal and wherein the method determines the first potential further based upon the engine coolant outlet temperature signal and the transmission fluid temperature signal.

12. The method of claim 9, wherein the vehicle further includes an engine coolant inlet temperature sensor that generates an engine coolant inlet temperature.

13. The method of claim 12, wherein the vehicle further includes an engine oil temperature sensor that generates an engine oil temperature signal, wherein the engine oil heat exchanger is adapted to exchange heat between a coolant flowing through the engine oil heat exchanger and engine oil in the engine, and wherein the method determines the second potential further based upon the engine coolant inlet temperature signal and the engine oil temperature signal.

14. The method of claim 9, wherein the vehicle further includes an engine coolant inlet temperature sensor that generates an engine coolant inlet temperature signal, and an engine coolant outlet temperature sensor that generates an engine coolant outlet temperature signal, and wherein the transmission fluid heat exchanger adapted to exchange heat between a coolant flowing through the transmission fluid heat exchanger and transmission fluid in a transmission, the method further comprising proportionally distributing coolant flow based upon the engine coolant inlet temperature signal and the engine coolant outlet temperature signal.

15. The method of claim 9, wherein the coolant pump comprises an electronically controlled variable flow coolant pump.

16. The method of claim 15, further comprising controlling the flow of coolant through the electronically variable coolant pump based upon a result of the comparison.

* * * * *